US011738840B2

(12) United States Patent
Winner

(10) Patent No.: US 11,738,840 B2
(45) Date of Patent: Aug. 29, 2023

(54) HAND-HELD WING RIG FOR FOILING

(71) Applicant: BOARDS & MORE GMBH, Molln (AT)

(72) Inventor: Ken Winner, Oberhaching (DE)

(73) Assignee: BOARDS & MORE GMBH, Molln (AT)

( * ) Notice: Subject to any disclaimer, the term of this patent is extended or adjusted under 35 U.S.C. 154(b) by 33 days.

(21) Appl. No.: 17/425,168

(22) PCT Filed: Jan. 22, 2020

(86) PCT No.: PCT/EP2020/051463
§ 371 (c)(1),
(2) Date: Jul. 22, 2021

(87) PCT Pub. No.: WO2020/152198
PCT Pub. Date: Jul. 30, 2020

(65) Prior Publication Data

US 2022/0119086 A1 Apr. 21, 2022

(30) Foreign Application Priority Data

Jan. 23, 2019 (DE) ..... 10 2019 101 656.8

(51) Int. Cl.
*B63H 9/067* (2020.01)

(52) U.S. Cl.
CPC ..... *B63H 9/067* (2020.02)

(58) Field of Classification Search
CPC ... B63H 9/00; B63H 9/04; B63H 9/06; B63H 9/067; B63H 9/069; B63H 9/08; B63H 2009/082; B63H 8/00; B63H 8/10; B63H 8/12; B63H 8/14; B63H 8/16; B63H 8/18; B63H 8/40
USPC ..... 114/102.1, 102.11, 102.12, 102.15, 114/102.16, 102.22, 102.23, 102.24, 114/102.29, 39.11, 39.12, 39.16, 39.18, 114/39.21, 39.22, 89, 97; 440/8
See application file for complete search history.

(56) References Cited

U.S. PATENT DOCUMENTS 3,487,800 A * 1/1970 Drake ..... B63H 8/23 114/91
4,533,159 A * 8/1985 Seidel ..... B63B 32/00 280/810

(Continued)

FOREIGN PATENT DOCUMENTS

DE 3140685 A1 4/1983
DE 3421503 A1 12/1985

(Continued)

OTHER PUBLICATIONS

German Search Report re DE102019101656.8 dated Dec. 3, 2019 with English machine translation (16 pages).

(Continued)

*Primary Examiner* — Daniel V Venne
(74) *Attorney, Agent, or Firm* — Mindful IP PLLC; Michael J. McCandlish

(57) ABSTRACT

A hand-held wing is configured to include an inflatable leading edge from which a substantially rigid boom extends which is configured to be held by the user to guide the wing, with the leading edge being configured to extend about V-shaped or U-shaped upwards (away from the surfer) in the direction of approach.

22 Claims, 5 Drawing Sheets

(56) References Cited

U.S. PATENT DOCUMENTS

| | | | | |
|---|---|---|---|---|
| 4,563,969 | A | | 1/1986 | Le Bail |
| 4,651,665 | A | * | 3/1987 | Drake ..... B64C 31/028 D12/303 |
| 5,448,961 | A | | 9/1995 | Ansteensen |
| 5,826,530 | A | | 10/1998 | Tuurna et al. |

FOREIGN PATENT DOCUMENTS

| | | | |
|---|---|---|---|
| DE | 69414856 | T2 | 6/1999 |
| DE | 102016113858 | A1 | 9/2017 |
| EP | 1151918 | A1 | 11/2001 |
| WO | 9505973 | A1 | 3/1995 |

OTHER PUBLICATIONS

International Search Report re PCT/EP2020/051463 dated Mar. 24, 2020 (2 pages).
Written Opinion re PCT/EP2020/051463 (5 pages).
European Patent Office 2nd European office Action, issued against correlated foreign application No. 20 701 589.2 1009 dated Dec. 14, 2022.
Office Action issued against correlated DE application No. 10 2019 101 656.8 dated Apr. 19, 2023.
Logosz, Instagram; https://www.instagram.com/p/-Ie3jFOAc8/?hl-fi; retrieved on Apr. 19, 2023.
Logosz; Nov. 16, 2015 Instagram; https://www.instagram.com/p/-ljGSeOASj/; retrieved on Apr. 19, 2023.
Tony Logosz on Instagram "Anyone up for getting smoked . . . " Oct. 5, 2015. URL: https://www.instagram.com/b/2gmahy0AQ1/?taken-by=logosz [retrieved Apr. 19, 2023].

* cited by examiner

HAND-HELD WING RIG FOR FOILING

CROSS REFERENCE TO RELATED APPLICATIONS

The present patent application is a national stage of, and claims priority to, Patent Cooperation Treaty Application No. PCT/EP2020/051463, filed on Jan. 22, 2020, which application claims the priority of the German patent application DE 10 2019 101 656.8 of 23 Jan. 2019, the disclosures of which are incorporated in the present patent application by reference.

TECHNICAL FIELD

The disclosure relates to a hand-held wing for wind-powered sports such as foil surfing, in accordance with the preamble of the independent claim.

BACKGROUND

Such wing is described on the Internet under the name "Slingwing". Basically, it is a kite having a leading edge and one single strut which are inflatable. At each of the center strut and the leading edge, holding straps are formed via which the user holds the inflatable wing during use, for example during foiling or during ice-skating or during skiing.

This inflatable wing adapted to the aerodynamics of kites is strongly deformed during use, especially at the high speeds reached during foiling, and thus the aerodynamics are deteriorated.

In U.S. Pat. No. 4,563,969, a rigid wing is illustrated in which the leading edge and a boom are formed by a complex tubular design that spans a sailcloth (canopy). The leading edge is curved in an arc shape, when viewed in a top view. The boom is supported on the leading edge by a plurality of struts. Said struts are configured so that, when viewed in a front view, i.e., in the direction of approach of the wing, they impart to the leading edge a concave structure according to which the end portions (tips) of the wing are opened upwards from a central apex of the leading edge.

It is a drawback of this solution that the complex structure of the boom and the leading edge cause the total weight of the wing to be very high so that a use in water sports is possible only with appropriate buoyancy members. It is another drawback that the rigging and unrigging of the wing is very time-consuming due to the complex tubular structure. This hard tubular structure of the leading edge and the boom also entails considerable risk of injury for the user in the case of overthrow.

A similar rigid wing is shown in WO 95/05973 A1. In this solution, too, the leading edge and the boom are formed by a complex tube structure. The design has the same drawbacks as the wing according to the afore-discussed U.S. Pat. No. 4,563,969.

In DE 31 40 685 A1, a rigid wing is described in which the leading edge is configured by two V-shaped masts which are interconnected by a central boom and struts. Due to its tube structure, this wing, too, has a considerable weight which significantly impedes handling especially in water sports.

In U.S. Pat. No. 5,448,961 a flat wing having a closed frame structure is described—such a solution is also useless for water sports due to the high weight, the time-consuming mounting/dismounting and the risk of injury.

SUMMARY

On the other hand, the object underlying the disclosure is to provide a hand-held wing which allows for easy rigging and maintains an aerodynamically optimized profile even at high sailing velocities.

This object is achieved by a hand-held wing comprising the features of the independent claims.

Advantageous developments of the disclosure are the subject matter of the dependent claims.

The hand-held wing according to the disclosure is suited for wind-powered sports such as for foil surfing and the accompanying high velocities. The wing has a leading edge that is preferably designed to be inflatable, from which a boom extends, wherein the leading edge and the boom span a canopy. During use, the wing is held especially at the boom. The leading edge is curved, in a top view, approximately in an arc shape, delta shape, U shape or C shape away from a connection of the boom toward the leech (trailing edge) of the canopy. The leading edge is further approximately V-shaped or U-shaped in the non-approached or unloaded state in a front view viewed in the direction of approach, wherein this profile converges toward the boom. In other words, during use the profile opens upward away from the operator. Surprisingly, it turned out that by such distinct V or U profiling and the arc-shaped, delta-shaped or U-shaped or C-shaped configuration of the leading edge (when viewed in a top view) even at high wind and sailing speeds an aerodynamically optimized profile is formed which, on the one hand, automatically opens in gusts and thus reduces the resulting pressure to be supported by the user and, on the other hand, generates low aerodynamic resistance at the high sailing speeds. By appropriate inclination of the wing, a maximum sailing speed or else a maximum buoyancy for jumps or the like can be generated depending on the apparent wind direction.

In accordance with the disclosure, the boom is preferably configured as a rigid non-inflatable component. The term "rigid component" is understood to be a structure formed of a largely stiff material, which structure, however, can be designed to be easily dismountable or else telescopic. The boom is configured to facilitate holding of the wing during use.

The boom is preferably configured to include a sheathing for improving the grip fit/friction fit.

In an example, the approximately V- or U-shaped profile extends away from the leading edge toward the trailing edge of the canopy. I.e., the entire wing profile is profiled, in a front view (when viewed in the direction of attack), to open upwards.

The efficiency of the wing is further improved when the V- or U-angle is maximum in the connection area of the boom and decreases toward the tips. Accordingly, the angle of inclination with the horizontal (parallel to the connecting line through the tips) is preferred to range from 10° to 30°, preferably is more than 15°, especially preferred about 20° in the apex area. The "angle of inclination" is understood to be the angle which the respective area of the leading edge adopts when the wing is positioned in parallel to the water surface/useable surface, i.e., to the horizontal. The opening angle between the leading-edge areas tilted/inclined relative to each other consequently corresponds to the difference between 180° and double the angle of inclination (complementary angle to 180°). The trailing edge (leech) is configured to have a corresponding profile angle.

The aerodynamics are further improved when the angle of inclination in the tip area ranges from 0° to 20°, preferably is more than 1°, preferably about 5°.

In a variant of the disclosure, the wing is configured so that the mean angle of inclination, i.e., the angle from the apex of the leading edge to the respective tip, ranges from 5° to 20°, preferably is about 10°.

For adaptation to plural wing sizes, the boom can be designed to be telescopic or to consist of plural replaceable segments.

The device expenditure is especially low, when the boom is replaceably fastened to the leading edge and the trailing edge by means of a holding fixture. In this way, one single boom can be used for plural wings.

For minimizing the weight, it is advantageous to design the boom in tube shape.

The flying stability of the wing is further improved when the holding fixture of the boom is configured such that it obstructs rotation of the leading edge about its longitudinal axis.

Accordingly, the holding fixture is especially preferred to encompass portions of the leading edge and thus to suppress rotation.

In an alternative solution, the holding fixture can also penetrate the leading edge. In such configuration, appropriate receptacles for the holding fixture and, resp., the boom must be formed at the leading edge. Moreover, a channel into which the holding fixture or the boom can be inserted should be provided.

In an example of the wing, the boom is configured to be unstrutted. Such a solution is weight-optimized, on the one hand, and enables the user, on the other hand, to variably hold the boom and thus the wing depending on the respective sailing maneuver and the ambient conditions.

In an example of the wing, the center of canopy is distanced from the leading edge at least 30 percent, preferably more than 40 percent of the distance between the apex of the leading edge and the trailing edge (leech).

For further optimizing the approach profile, the leading edge and/or the canopy may be stiffened by means of stiffening members such as battens.

Those battens may in turn be curved and/or tapered for profiling the wing profile.

In an example, a batten extends from the leading edge to the trailing edge, said batten being positioned such that it is located in a vertical plane with the boom (when the wing is horizontally aligned).

To facilitate handling, a handle may preferably be provided at the leading edge in the connecting area of the boom.

In order to prevent the wing from being separated from the user during overthrow, the wing is designed to include a safety leash.

Applicant reserves the right to direct a separate independent claim to a wing having the afore-described V- or U-profile and a rigid non-inflatable leading edge.

The holding fixture for connecting the boom to the leading edge can be formed, for example, by a profile section which encompasses portions of the leading edge and is attached to the leading edge via suitable fasteners. Then the boom is inserted into or otherwise connected to the profile section.

In an alternative solution, a holding fixture for the boom is formed at the leading edge by means of profile sections or sailcloth. Said profile sections again encompass the leading edge in portions so that rotation of the leading edge is suppressed during use.

The boom preferably extends from the leading edge to the trailing edge without being directly or tightly connected to the canopy in the intermediate areas so that virtually the entire boom length is available as handle area. In this way, it is ensured that holding of the wing in all maneuvers can be optimally selected as preferred by the user. Moreover, the profile depth can be set by adjusting the boom length.

The structure of the wing is designed so that, in the approached state, i.e., when the wing is used, especially the opening angle is reduced in the area of the trailing edge. This means that the angle of inclination $\alpha$ of the trailing edge areas with the horizontal is increased during use. Accordingly, also the profile depth can increase in the approached state. The variation of the opening angle may be larger in the trailing edge area than in the leading edge area.

The boom is preferably fastened to the area facing away from the canopy at the apex of the leading edge.

The fastening is such that the wing can be laterally pivoted/inclined by rotating the boom about its longitudinal axis—this would not be possible by way of straps (handles), as they are not rigid and thus no torque can be applied.

BRIEF DESCRIPTION OF THE DRAWINGS

In the following, examples of the disclosure will be illustrated in detail by way of schematic drawings, wherein.

DESCRIPTION

Figure 1:
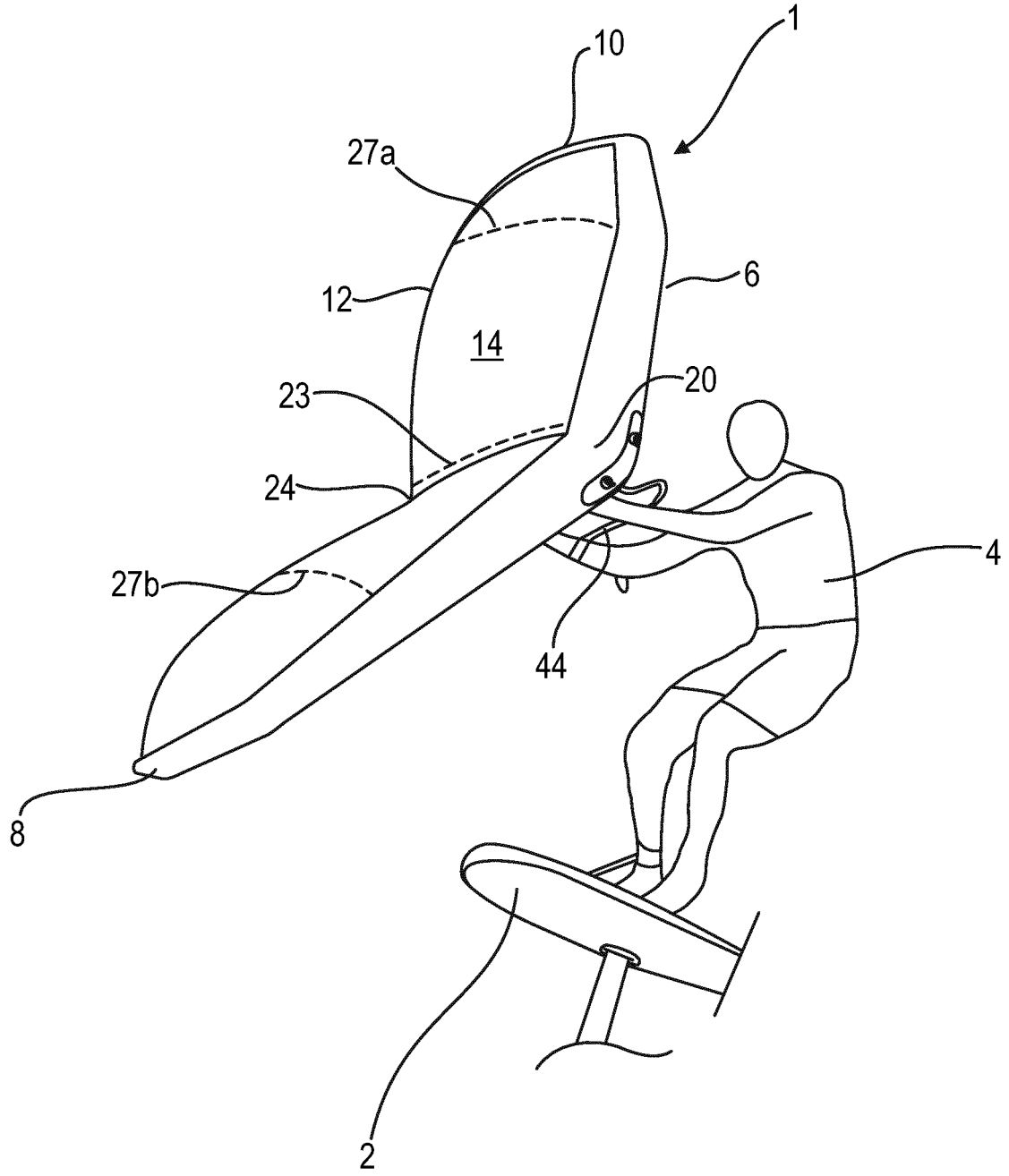
FIG. 1 shows a schematic diagram of an example of a wing used to drive a foil board.

FIG. 1 illustrates the use of a wing 1 according to the disclosure for driving a foil board 2. A surfer 4 holds the wing 1 merely with his/her hands and adjusts the same relative to the wind depending on the desired sailing direction (upwind, half wind, downwind) or depending on the buoyancy to be set, for example when jumping or adjusting the course.

The wing 1 includes an inflatable leading edge 6 which in a top view (from above in FIGS. 1 and 2) is designed to be approximately arc-shaped, preferably approximately delta-shaped, C-shaped or U-shaped and with its tips 8, 10 extends to a trailing edge 12 of a canopy 14 of the wing 1. As will be explained hereinafter, said canopy 14 is spanned, on the one hand, from the leading edge 6 and, on the other hand, from a boom 16 to be detailed further below (see FIG. 3). Accordingly, the surfer 4 holds the wing 1 merely at the boom 16 that projects downwards (view according to FIG. 1). The boom 16 is preferably provided with a sheathing facilitating/optimizing the gripping and holding. As will be illustrated below, the leading edge 6 is inclined in V- or U-shape both in the top view (FIG. 2) and in a front view—when viewed in the direction of approach—(see FIG. 4), wherein in the front view the V/U expands upwards and thus away from the surfer. As is evident from FIG. 1, also the trailing edge 12 and, thus, the entire canopy surface 14 is inclined in V- (or U-) shape in the front view.

Figure 2:
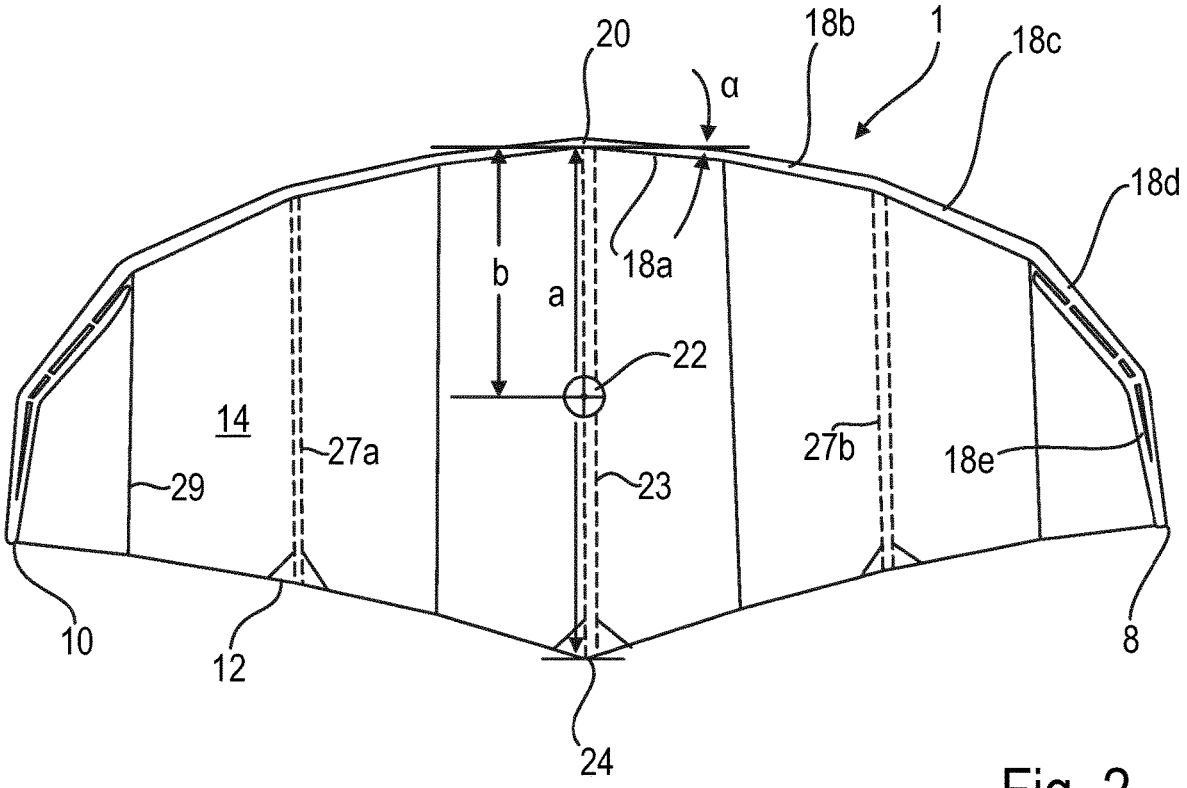
FIG. 2 shows a top view onto a wing according to FIG. 1.

FIG. 2 illustrates a top view onto the wing 1 according to FIG. 1. In this representation, the approximately arc-shaped or delta-shaped, in the broadest sense approximately U- or C-shaped leading edge 6 is visible which extends up to the trailing edge 12 of the canopy 14. In the shown example, the leading edge 6 is configured, in the form of a kite, by a front tube in which a bladder that is inflated via a valve is accommodated, wherein the pressure is selected so that the structure of the wing 1 is guaranteed even at high wind forces and sailing speeds.

In the shown example, the leading edge 6 is formed by a plurality of tube segments 18*a*, 18*b*, 18*c*, 18*d*, 18*e* (for reasons of simplification, only one half of the trailing edge 12 is provided with reference numerals) whose angle of incidence a with the horizontal in FIG. 2 (i.e., with a connecting line between the two tips 8, 10, for example) increases from an apex 20 to the tips 8, 10. Said angle of incidence a is inserted, by way of example, at the tube segment 18*a*. The reference numeral 22 marks the center of canopy. Said center of canopy 22 is arranged to be offset against at least 40 percent of the distance between the apex 20 and the corresponding apex 24 of the trailing edge 12 away from the apex 20. The distance between the apices 20, 24 is marked by the reference numeral a in FIG. 2. Accordingly, the distance b between the apex 20 and the center of canopy 22 amounts to at least 40 percent of the distance a.

This center of canopy 22 is selected so that the surfer 4 can optimally grasp the boom 16 detailed further below and thus can support the impacting wind forces in order to sail an optimum upwind course, for example.

For stiffening the wing profile, a center batten 23 and two battens 27*a*, 27*b* offset toward the tips 8, 10 are provided which extend between the leading edge 6 and the trailing edge 12 and are inserted in corresponding batten pockets of the canopy 14. The battens are inserted in a manner known per se with a certain pretension that is selected corresponding to the desired profiling or else is variable so that the profile can be adapted to different wind speeds. In FIG. 2, reference numeral 29 further denotes seams of the canopy 14 which is composed of plural panels. It may also be sufficient to design the panels such that they are sewn up merely in the area of the battens and extend continuously from tip 8 to tip 10.

Figure 3:
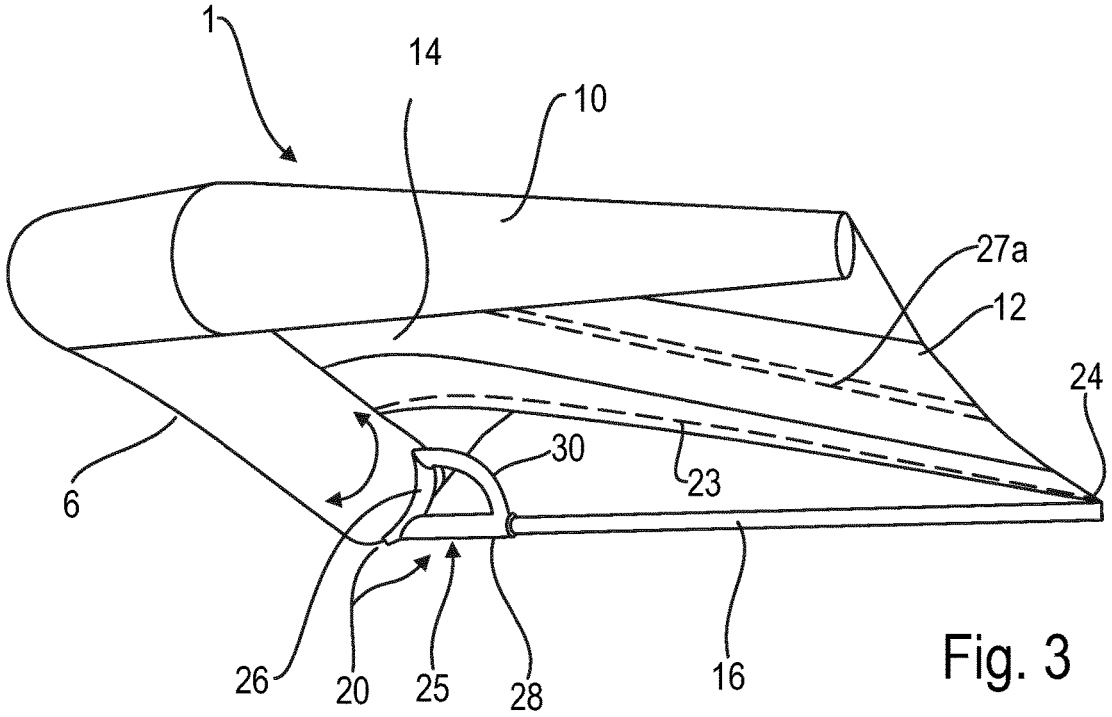
FIG. 3 shows a lateral view of the wing according to FIGS. 1 and 2.

In the lateral view according to FIG. 3, the leading edge 6 is shown with the tip 10 on the left in FIG. 2 and the boom 16 acting upon the leading edge 6 in the area of the apex 20. As illustrated, the tube forming the leading edge 6 together with the boom 16 and the battens 23, 27 spans the canopy 14, the boom 16 also acting upon the apex 24 of the trailing edge 12 of the canopy 14 and therebetween preferably being not connected to the canopy 14. The center batten 23 extends in parallel to the longitudinal extension of the boom 16 between the leading edge 6 and the trailing edge 12. Accordingly, also this batten 23 on the one hand acts upon the apex 20 of the leading edge 6 and, on the other hand, acts upon the apex 24 of the trailing edge 12. The boom 16 and the center batten 23 thus are located in the same vertical plane which in FIG. 2 is perpendicular to the plane of projection and in FIG. 3 lies in the plane of projection. The space between the boom and the batten 23/canopy 14 is thus free so that the surfer can choose unhindered his/her gripping position depending on the maneuver/course.

As is moreover obvious from FIG. 3, the leading edge 6 is also profiled perpendicularly to the plane of projection in FIG. 2. Concretely, the leading edge 6 is V-shaped away from the apex 20 toward the tips 8, 10, the V (also referred to as opening angle δ)—as shown in FIG. 1—opening upwards, viz. away from the boom 16. Said V-profile is correspondingly formed also in the area of the canopy 14. This is achieved, inter alia, in the representation according FIG. 3, by the boom 16 spanning the apex 24 downwards, i.e., away from the tips 8, 10 and thus configuring the V-shape that is defined by the opening angle δ. In accordance with the disclosure, the structure of the wing 1 is designed so that said opening angle δ decreases in the approached state, as the load causes the tips 8, 10 to deflect upwards (away from the surfer 4). The boom 16 acts on the (bottom) area of the apex 20 of the leading edge 6 spaced from the canopy 14.

Figure 4:
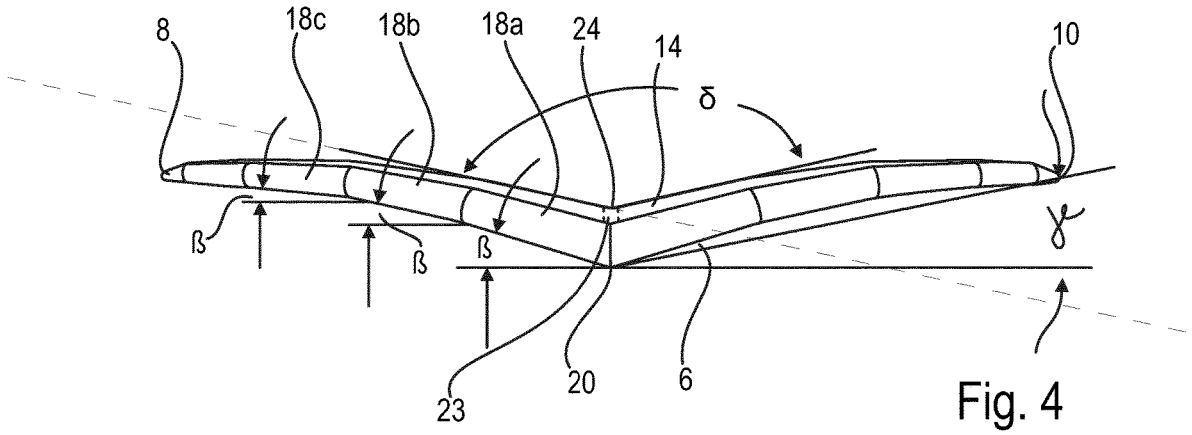
FIG. 4 shows a front view of a wing according to FIGS. 1 to 3.

The V-shape is especially clearly visible in the front view according to FIG. 4. In this representation, the leading edge 6 formed by the tube is arranged facing the viewer. The canopy 14 is correspondingly inclined in V-shape. As inserted in FIG. 4, the angle of inclination β of the leading edge 6 is maximum in the area of the apex 20. In the shown example, said angle of inclination β, i.e., the angle between the horizontal (parallel to the connecting line of the tips 8, 10) and the tube segment 18*a* is about 20°, for example. The next tube segment 18*b* then is inclined to be somewhat flatter so that the angle amounts to 15°, for example. The angle of inclination of the following segments 18*c*, 18*d*, 18*e* in turn is flatter, wherein the angle of inclination β in the area of the segment 18*c* may be, for example, 5°. The "mean" angle of inclination γ viewed over the entire wing 1 is 10°, for example, so that the "mean" opening angle then is approximately 160°.

In the described examples, the boom 16 is configured to be unstrutted—this is a substantial difference from the complex designs described at the outset in which the boom is configured to have a plurality of transverse and diagonal struts. In the solution according to the disclosure, the boom 16 can be detachably fastened to the apex 20 of the leading edge 6 via a holding fixture 25.

In the illustrated example, the holding fixture 25 has a supporting bracket 26 formed corresponding to the outer contour of the apex 20 and encompassing portions thereof. Said encompassing is carried out such that, in the case of comparatively high wind load, rotation of the tube, viz. the tube segments 18*a* forming the apex 20, in the arrow direction and thus twisting of the profile is reliably prevented.

In the direction of the boom 16, a receptacle 28 into which the boom 16 is inserted is connected to the supporting bracket 26. The end portions of the supporting bracket 26 and the receptacle 28 are connected via an arc-shaped handle 30 which facilitates handling of the wing 1 before and after use for the surfer 4. For example, when not being used, the wing 1 can be held at the handle 30 to have it fly in the wind. The holding fixture 5 and the boom 16 are preferably made from a lightweight material, such as from aluminum, fiber-reinforced plastic, carbon-fiber materials or any other high-strength lightweight construction materials. Due to the simple structure of the boom 16, the latter has a minor influence on the total weight of the wing 1.

Figure 5:
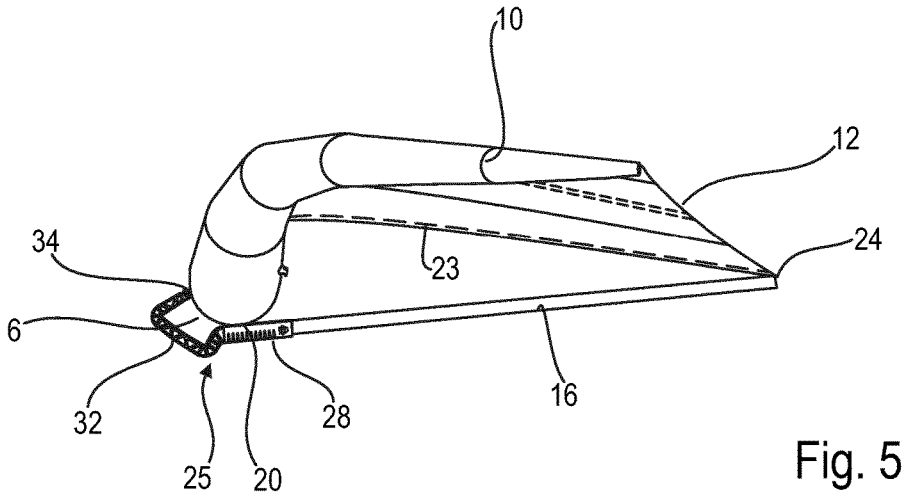
FIG. 5 shows a lateral view of another example of a wing.
Figure 6:
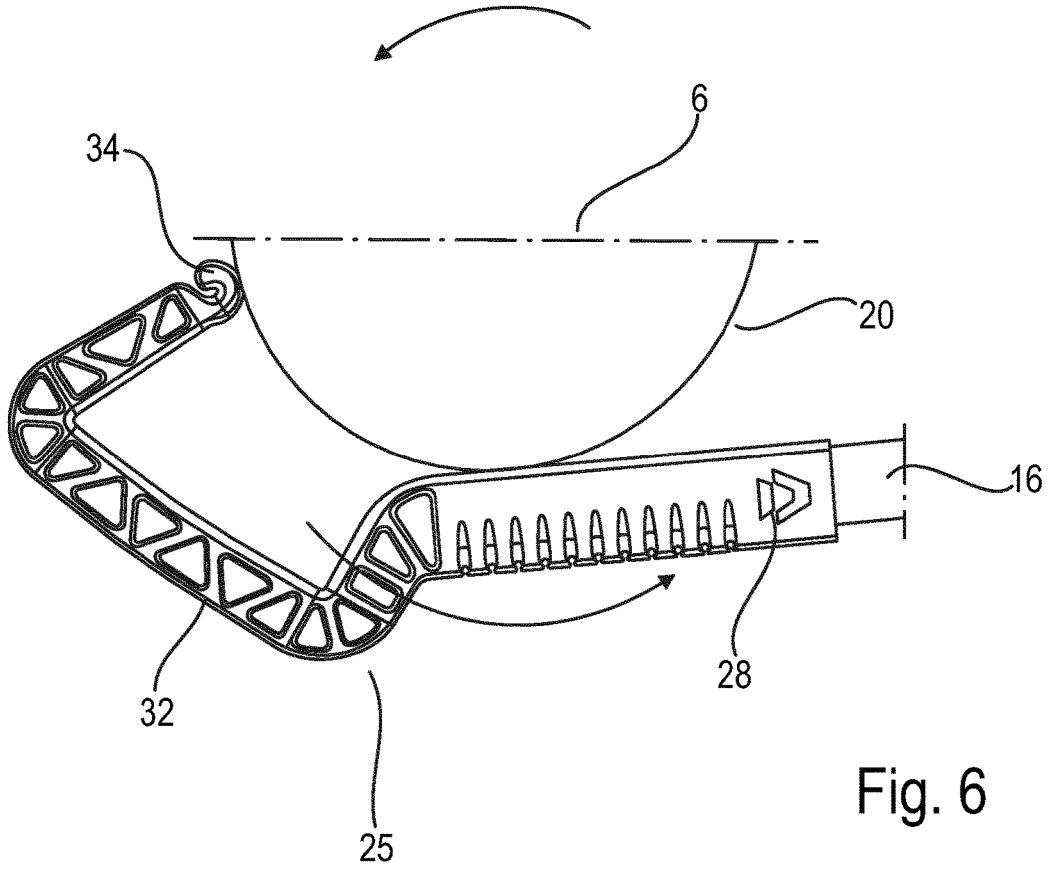
FIG. 6 shows a detail view of the wing according to FIG. 5.

FIG. 5 illustrates a lateral view of a variant of the afore-described example of a wing 1. The view approximately corresponds to that of FIG. 3. That is, in this view the tip 10 is visible with the V-shaped leading edge 6 which has its lowest point in the area of the apex 20. The apex 24 of the trailing edge 12 is braced downward from the boom 16 (view toward FIG. 5). The holding fixture 25 of the boom 16 in turn includes a receptacle 28 into which the boom 16 is inserted or which is connected to the boom 16 in any other way. The apex 20 rests against the upper side of the receptacle 28 according to FIG. 6. An approximately U-shaped handle 32 in lightweight design extends away from the receptacle 28, with the end portion of the handle acting, at a distance from the support of the apex 20, upon the receptacle 28, i.e., offset toward the canopy 14 upon the apex 20 formed by the tube segments 18*a*. As the support of the apex 20 is spaced apart from the receptacle 28, on the one hand, and from the end portion 34 of the handle 32, on the other hand, the afore-described rotation of the leading edge 6 (front tube) is equally suppressed.

The U structure of the handle 32 allows the wing 1 to be easily held for flying. As is especially shown in FIG. 6, the handle 32 exhibits a truss structure. The connection of the receptacle 28 and of the end portion 34 to the apex can be made via suitable fixing members at the tube segments 18*a*. Those fixing members are preferably configured so that the handle 30 is detachably connected to the leading edge 6 (front tube).

Instead of the handle 30, handle 32 being integrated more or less in the boom structure, the handle may also be a strap at the approach side of the leading edge 6 so that the surfer can allow the wing 1 to fly while holding it with his/her hand, for example during surfing.

Figure 7:
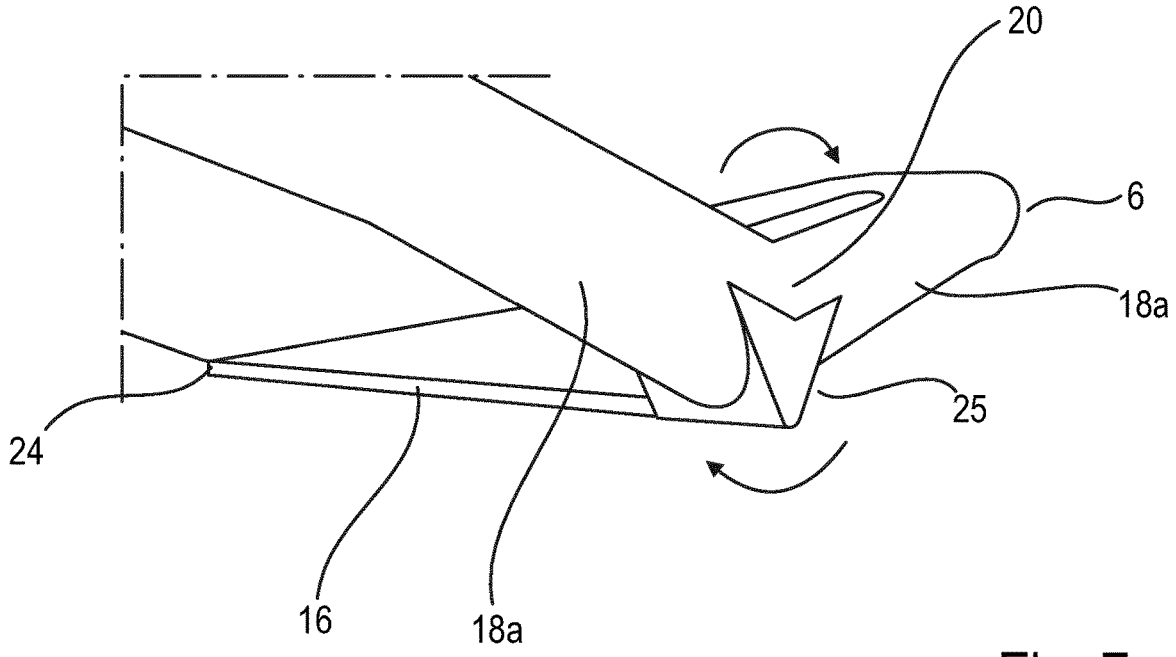
FIG. 7 shows a partial representation of another example of a wing.

FIG. 7 illustrates an example in which the holding fixture 25 is a flat body designed to encompass portions of the leading edge 6 and, resp., of the tube segments 18*a*.

Said flat holding fixture may be a molded body, for example. In an especially simple example, the holding fixture 25 is made from sailcloth which is connected to the apex 20 of the leading edge 6 and is stabilized, where necessary, by appropriate stiffening members. Then the boom 16 can be inserted in turn into said holding fixture 25. In this example, too, the holding fixture 25 is designed so that the tube (leading edge 6) is prevented from rotating in the arrow direction by being supported by means of the boom 16.

In the afore-described examples, the front tube is designed—as described—to have a continuous bladder. In the example according to FIG. 8, preferably for each wing half a separate bladder is used, wherein, according to the representation in FIG. 8, a support channel 36 into which the boom 16 is inserted is maintained between said two bladders. In this way, a two-chamber system is formed which ensures sufficient buoyancy even if one bladder is damaged so that the wing 1 will not sink. Such support channel 36 can be formed by a tubular piece which diametrically penetrates the front tube. Said support channel 36 is formed between the two bladders of the two wing halves (left, right). For further stabilization, a bearing ring 40 extending in extension of the support channel 36 and being penetrated by the boom 16 is formed at an outer cover 38 of the front tube (leading edge 6). Said bearing ring 40 absorbs the compressing forces and is designed similarly to the support rings of the commonly used kite valves.

Figure 8:
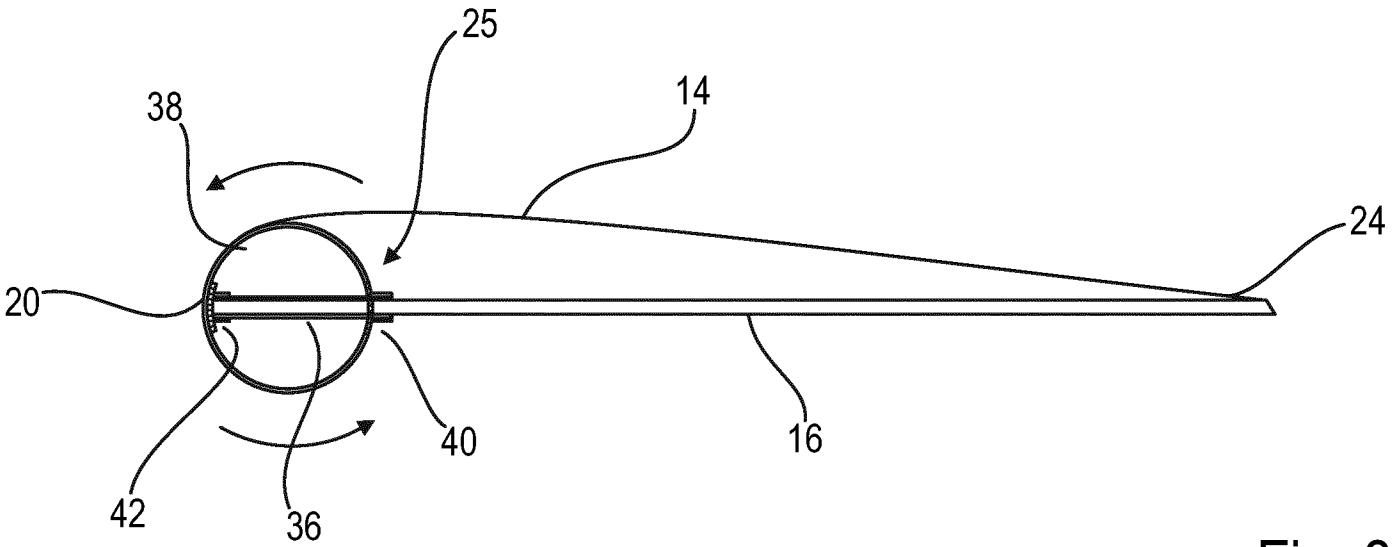
FIG. 8 shows a schematic diagram of another example of a wing.

A similar support ring 42 is provided opposite to the bearing ring 40 on the inner side of the outer cover 38 on which the left end portion in FIG. 8 of the boom 16 is supported. I.e., the boom 16 is connected by force fit and form fit to the outer cover 38 so that the apex 20 and, hence, the front tube are prevented from twisting in the arrow direction. As explained, the tubular support channel 36 is connected, on the one hand, to the bearing ring 40 and, on the other hand, to the support ring 42 so that the boom 16 is reliably fixed in position.

Such a solution offers the advantage that the bearing rings 40 and the support rings 42 can be used virtually for any front tube diameter—merely the length of the support channel 36 must be adapted. In such a solution, the boom 16 is supported in a very stable manner so that the holding forces introduced by the surfer 4 and also the compressing forces transmitted by the front tube are reliably absorbed without the boom 16 being excessively deformed. The support channel 36 and the rings 40, 42 are preferably in the form of plastic injection-molded parts.

In all afore-described examples, the canopy 14 can be stabilized through battens or the like. Said battens may be conical or profiled to optimize the shape of flow of the canopy 14. Accordingly, also the leading edge 6 can be stiffened by suitable stiffening members so that the wing 1 maintains the shown aerodynamically optimized shape even when exposed to high loads.

Said battens or stiffening members can also be in the form of carbon-fiber tubes or the like.

In one example, the battens are profiled so that they are initially adapted to the diameter of the leading edge 6 (front tube) and then support the canopy 14. As a matter of course, battens can be inserted additionally or alternatively into the canopy 14 from the trailing edge 12.

In order to prevent the wing 1 from drifting off in the case of overthrow, the wing 1 is connected to the surfer 4, and especially to his/her arm, via a safety leash 44.

Thus is disclosed a hand-held wing which is preferably designed to include an inflatable leading edge which is designed to expand approximately V-shaped or U-shaped upwards (away from the surfer) in the direction of attack.

LIST OF REFERENCE NUMERALS

1 wing
2 foil board
4 surfer
6 leading edge/front tube
8 tip
10 tip
12 trailing edge
14 canopy
16 boom
18 tube segment
20 apex of leading edge
22 center of canopy
24 apex of trailing edge
25 holding fixture
26 supporting bracket
27 batten
28 receptacle
29 seam
30 handle
32 handle
34 end portion
36 support channel
38 outer cover
40 bearing ring
42 support ring
44 safety leash
$\alpha$ angle of attack
$\beta$ angle of inclination
$\gamma$ angle of inclination toward the tips
$\delta$ opening angle ($180°-2\beta$)

What is claimed is:

1. A hand-held wing for foiling, skating or skiing, configured to be held only by hands of a user during use of the hand-held wing, comprising:

a leading edge including an inflatable front tube having a tube shape;

a boom extending from the leading edge which is configured to span a canopy and to be held by the user to hold and guide the hand-held wing; and the canopy extending from the leading edge and spanned by the leading edge and the boom;

wherein:

the leading edge in a top view is curved away from a connection of the boom toward a trailing edge of the canopy approximately in delta-, U- or C-shape; at least the leading edge with the inflatable front tube in an unloaded state is configured, when viewed in a direction of approach, to converge approximately V-shaped or U-shaped toward the boom and to open upwards away from the user;

the boom is a rigid or inflatable component; and the hand-held wing is configured to be held only by the hands of the user during the use of the hand-held wing.

2. The hand-held wing according to claim 1, wherein an approximately V-shaped or U-shaped profile extends to the trailing edge of the canopy.

3. The hand-held wing according to claim 1, wherein an angle of inclination (β) is maximum in an apex area of the leading edge and decreases toward tips of the leading edge.

4. The hand-held wing according to claim 3, wherein the angle of inclination (β) toward a horizontal in the apex area ranges from 10° to 30°.

5. The hand-held wing according to claim 3, wherein the angle of inclination (β) ranges, in an area of the tips, from 0° to 20°.

6. The hand-held wing according to claim 3, wherein a mean angle of inclination (γ) from an apex to the tips ranges from 5° to 20°.

7. The hand-held wing, according to claim 1, wherein the boom is replaceably fastened to the leading edge by a holding fixture.

8. The hand-held wing according to claim 1, wherein the boom is tube-shaped.

9. The hand-held wing according to claim 1, wherein the boom is designed to be telescopic or to have a variable length.

10. The hand-held wing according to claim 1, wherein a holding fixture is configured to obstruct rotation of the leading edge about a longitudinal axis of the leading edge.

11. The hand-held wing according to claim 10, wherein the holding fixture encompasses portions of the leading edge.

12. The hand-held wing according to claim 10, wherein the holding fixture penetrates the leading edge and respectively, a front tube.

13. The hand-held wing according to claim 1, wherein a center of the canopy is about 40% of a distance (a) between an apex of the leading edge and an apex of the trailing edge.

14. The hand-held wing according to claim 1, wherein the canopy is stiffened by stiffening members.

15. The hand-held wing according to claim 14, wherein the stiffening members are battens.

16. The hand-held wing according to claim 14, wherein a center batten extends from the leading edge to the trailing edge and is arranged with the boom approximately in a vertical plane.

17. The hand-held wing according to claim 1, wherein a handle is provided in a connecting area of the boom to the leading edge.

18. The hand-held wing according to claim 1, further comprising a safety leash for connecting the hand-held wing to the user.

19. The hand-held wing according to claim 1, wherein the hand-held wing is configured such that, in an approached/loaded state, an angle of inclination increases at least in an area of the trailing edge during an approached state as compared to the unloaded state.

20. The hand-held wing according to claim 1, wherein the boom acts upon an area of the leading edge remote from the connection of the canopy or upon an apex.

21. The hand-held wing according to claim 1, wherein the boom is connected to the leading edge such that a torque applied about a longitudinal axis of the boom can be transmitted to the leading edge for laterally pivoting/inclining the hand-held wing.

22. The hand-held wing according to claim 1, wherein the boom is sheathed.

* * * * *